US005572174A

United States Patent [19]

Kitaichi et al.

[11] Patent Number: 5,572,174

[45] Date of Patent: Nov. 5, 1996

[54] DIELECTRIC RESONATOR DEVICE HAVING RESONATOR ELECTRODES WITH GAPS, AND METHOD OF MANUFACTURING THE SAME

[75] Inventors: Yukihiro Kitaichi, Ishikawa-ken; Yasuo Yamada, Kanazawa, both of Japan

[73] Assignee: Murata Manufacturing Co., Ltd., Japan

[21] Appl. No.: 182,664

[22] Filed: Jan. 13, 1994

Related U.S. Application Data

[63] Continuation of Ser. No. 966,555, Oct. 26, 1992, abandoned.

[30] Foreign Application Priority Data

Oct. 25, 1991 [JP] Japan ..... 3-087755 U
Sep. 28, 1992 [JP] Japan ..... 4-258153

[51] Int. Cl.[6] ..... H01P 1/202

[52] U.S. Cl. ..... 333/206; 333/204; 333/222

[58] Field of Search ..... 333/202–207, 333/219, 219.1, 223, 222, 235

[56] References Cited

U.S. PATENT DOCUMENTS

| | | | |
|---|---|---|---|
| 3,505,618 | 4/1970 | McKee | 333/203 |
| 4,559,508 | 12/1985 | Nishikawa et al. | 333/206 X |
| 4,757,284 | 7/1988 | Ueno | 333/203 |
| 5,122,768 | 6/1992 | Ito et al. | 333/204 |

FOREIGN PATENT DOCUMENTS

| | | | |
|---|---|---|---|
| 0078201 | 5/1982 | Japan | 333/204 |
| 62-40802 | 2/1987 | Japan . | |
| 0140501 | 6/1987 | Japan | 333/204 |
| 2183603 | 8/1987 | Japan . | |
| 0219202 | 9/1988 | Japan | 333/204 |
| 0143402 | 6/1989 | Japan | 333/204 |
| 0044401 | 2/1992 | Japan | 333/206 |
| 0637896 | 12/1978 | U.S.S.R. | 333/206 |
| 2240432 | 7/1991 | United Kingdom . | |

OTHER PUBLICATIONS

Patent Abstracts of Japan, vol. 12, No. 324 (E–653) 2 Sep. 1988 & JP–A–63 090 201 (Mitsubishi Electric Corp.) 21 Apr. 1988. *abstract*.

Patent Abstracts Of Japan, vol. 6, No. 72 (E–105)(950) 7 May 1982 & JP–A–57 013 801 (Nippon Dengiyou Kousaku K. K.) 23 Jan. 1982 *abstract*.

Patent Abstracts Of Japan, vol. 13, No. 110 (E–728) 16 Mar. 1989, JP–A–63 283 201 (Murata Manufacturing Co., Ltd.) 21 Nov. 1988 *abstract*.

*Primary Examiner*—Benny T. Lee
*Assistant Examiner*—Justin P. Bettendorf
*Attorney, Agent, or Firm*—Ostrolenk, Faber, Gerb & Soffen, LLP

[57] ABSTRACT

A dielectric resonator device in which resonant electrodes are provided in or on a dielectric block, and another ground electrode is formed on an outer face of the dielectric block. Lengths of the resonant electrodes are determined according to desired resonance frequencies of the respective resonators, while widths of regions having no electrodes are determined according to the desired amounts of coupling between the respective resonators. Since the dielectric block may be standardized, various kinds of dielectric resonator devices having different characteristics can be obtained without increasing the required number of kinds of molding metal molds.

26 Claims, 4 Drawing Sheets

DIELECTRIC RESONATOR DEVICE HAVING RESONATOR ELECTRODES WITH GAPS, AND METHOD OF MANUFACTURING THE SAME

This is a Continuation of application Ser. No. 07/966,555 filed on Oct. 26, 1992 now abandoned.

BACKGROUND OF THE INVENTION

1. Field of the Invention

The present invention generally relates to a dielectric resonator arrangement, and more particularly, to a dielectric resonator device constructed by forming a plurality of resonator electrodes on a dielectric substrate or dielectric block.

2. Description of Related Art

Conventionally, there have been employed a multi-stage dielectric resonator device constituted by forming a plurality of resonance electrodes (inner electrodes) within a dielectric block, and a ground electrode over the outer face of said dielectric block, and a strip-line type multi-stage resonator device having a plurality of resonance electrodes formed on the surface of a dielectric substrate, and a ground electrode formed on a confronting surface of said dielectric substrate, for example, as a band-pass filter, etc. in a microwave band region.

In the dielectric resonator device having a plurality of inner electrodes formed within the dielectric block, coupling bores or holes are formed to achieve coupling among respective resonators for setting of the amount of coupling by the size of such coupling bores. However, in this type of the resonator device in which the coupling bores are to be provided, not only is the productivity low in the manufacture, but it has been difficult to adjust the coupling amount properly.

Therefore, it has been considered to control resonator characteristics by adjusting the range over which the inner electrodes are formed, as shown in FIG. 4(A), which is a top plan view of a conventional dielectric resonator device, and FIG. 4(B) representing a side sectional view taken along the line IV(B)—IV(B) in FIG. 4(A).

In FIGS. 4(A) and 4(B), the known resonator device, for example, in the form of a symmetrical 4 stage band-pass filter, includes a dielectric block 1' with four through-holes formed therein, and inner electrodes 2*a*', 2*b*', 2*c*' and 2*d*' formed on the inner peripheral surfaces of said through-holes. The dielectric resonator device as referred to above may be represented by an equivalent circuit as shown in FIG. 5, in which R1, R2, R3 and R4 denote the resonators formed by the inner electrodes 2*a*', 2*b*', 2*c*' and 2*d*' as shown in FIGS. 4(A) and 4(B), with symbols K1 and K2 representing the coupling amounts between the respective neighboring resonators. In the dielectric resonator device having the construction as illustrated in FIGS. 4(A) and 4(B), for example, the resonance frequency of the resonator R2 is determined by a length L2' of the inner electrode 2*b*' at a second stage, while the coupling amount K2 is determined by a length S2' of a region in which the inner electrode is not formed, and an interval P2' between the inner electrodes 2*b*'–2*c*'.

When a filter is to be designed in which the relations represented by f1>f2 and K1>K2 are true, on the assumption that the dielectric resonator device shown in FIGS. 4(A) and 4(B) is constructed as the symmetrical 4 stage band-pass filter, and the resonance frequencies of the resonators R1 and R4 are represented by f1, and those of the resonators R2 and R3, by f2, the procedure for the design will be as follows.

(i) To determine the length L2' of the inner electrodes 2*b*' and 2*c*' according to the resonance frequencies f2.

(ii) To determine the length S2' of the region without the inner electrode and/or the intervals P2' between the inner electrodes 2*b*'–2*c*40 according to the coupling amount K2, with consequent determination of the axial length L thereby.

(iii) To determine the length L1' of the inner electrodes 2*a*' and 2*b*' according to the resonance frequency f1, with consequent determination of S1'.

(iv) To determine the interval P1' between the inner electrodes 2*a*'–2*b*' and 2*c*'–2*d*' according to the coupling amount K1.

Although the symmetrical 4 stage band-pass filter may be designed in the manner as described above, since the interval P1' and P2' between the inner electrodes are not constant according to the filter characteristics aimed at, different metal molds are required for each kind of filter, thus resulting in high manufacturing cost.

SUMMARY OF THE INVENTION

Accordingly, an essential object of the present invention is to provide a dielectric resonator device constituted by providing resonance electrodes on a dielectric member, which is arranged to obtain necessary characteristics without changing intervals between the neighboring resonance electrodes.

Another object of the present invention is to provide the dielectric resonator device of the above described type in many kinds which are different in characteristics without increasing the number of molding metal molds required for manufacturing thereof.

A further object of the present invention is to provide a method of manufacturing the dielectric resonator device of the above described type in an efficient manner at low cost.

In accomplishing these and other objects, according to the present invention, there are provided the dielectric resonator device and the method of manufacturing said dielectric resonator device characterized in the points as follows.

STRUCTURAL ASPECTS

A dielectric resonator device according to a first aspect of the present invention is characterized in that it includes a dielectric block having a first face and a second face generally parallel to each other, side faces continuous between said first and second faces, and through-holes extending from the first face to the second face through the dielectric block, an outer electrode formed over said first face, said second face, and said side faces of said dielectric block, and first inner electrodes and second inner electrodes formed, through gaps, at least in the vicinity of opening portions at one side, on inner peripheral surfaces of said through-holes.

A dielectric resonator device according to a second aspect of the present invention is characterized in that it includes a dielectric block having a first face and a second face generally parallel to each other, side faces continuous between said first and second faces and through-holes extending from the first face to the second face through the dielectric block, an outer electrode formed over said first face, said second face, and said side faces of said dielectric block, and first inner electrodes and second inner electrodes formed, through gaps, in the vicinity of opening portions of said first face, on inner peripheral surfaces of said through-holes.

A method of manufacturing a dielectric resonator device according to a third aspect of the present invention is characterized in that it includes the steps of forming a dielectric block having a first face and a second face generally parallel to each other, side faces continuous between said first and second faces, and through-holes extending from the first face to the second face through the dielectric block, applying, through formation, an outer conductor film onto said first face, second face and side faces of said dielectric block, and also, applying, through formation, first inner conductor films and second inner conductor films through gaps, at least in the vicinity of opening portions at one side, onto inner peripheral surfaces of said through-holes.

A method of manufacturing a dielectric resonator device according to a fourth aspect of the present invention is characterized in that it includes the steps of forming a dielectric block having a first face and a second face generally parallel to each other, side faces continuous between said first and second faces, and through-holes extending from the first face to the second face through the dielectric block, applying, through formation, an outer conductor film onto said first face, second face and side faces of said dielectric block, and also, applying, through formation, first inner conductor films and second inner conductor films through gaps, in the vicinity of opening portions of said first face, onto inner peripheral surfaces of said through-holes.

The method of manufacturing a dielectric resonator device according to a fifth aspect of the present invention is characterized in that in the method according to the third or fourth aspect, said dielectric block is formed through employment of common molding metal molds, thereby to produce dielectric resonator devices having various resonator characteristics by differentiating positions of the gaps within the respective through-holes.

The method of manufacturing a dielectric resonator device according to a sixth aspect of the present invention is characterized in that in the method according to the third or fourth aspect, said dielectric block is formed through employment of common molding metal molds, thereby to produce dielectric resonator devices having various resonator characteristic by differentiating widths of the gaps within the respective through-holes.

The method of manufacturing a dielectric resonator device according to a seventh aspect of the present invention is characterized in that in the method according to the third or fourth aspect, said dielectric block is formed through employment of common molding metal molds, thereby to produce dielectric resonator devices having various resonator characteristic by differentiating positions and widths of the gaps within the respective through-holes.

A dielectric resonator device according to an eighth aspect of the present invention is characterized in that it includes a dielectric block having a first face and a second face generally parallel to each other, side faces continuous between said first and second faces and through-holes extending from the first face to the second face through the dielectric block, an outer electrode formed over said first face, said second face, and said side faces of said dielectric block, and first inner electrodes and second inner electrodes respectively formed, through gaps, at least in the vicinity of opening portions at one side on inner peripheral surfaces of said respective through-holes.

A dielectric resonator device according to a ninth aspect of the present invention is characterized in that it includes a dielectric block having a first face and a second face generally parallel to each other, side faces continuous between said first and second faces and through-holes extending from the first face to the second face through the dielectric block, an outer electrode formed over said first face, said second face, and said side faces of said dielectric block, and first inner electrodes and second inner electrodes respectively formed, through gaps, in the vicinity of opening portions of said first face, on inner peripheral surfaces of said respective through-holes.

A method of manufacturing a dielectric resonator device according to a tenth aspect of the present invention is characterized in that it includes the steps of forming a dielectric block having a first face and a second face generally parallel to each other, side faces continuous between said first and second faces, and through-holes extending from the first face to the second face through the dielectric block, applying, through formation, an outer conductor film onto said first face, second face and side faces of said dielectric block, and also, applying, through formation, first inner conductor films and second inner conductor films through gaps, at least in the vicinity of opening portions at one side, onto inner peripheral surfaces of said respective through-holes.

A method of manufacturing a dielectric resonator device according to an eleventh aspect of the present invention is characterized in that it includes the steps of forming a dielectric block having a first face and a second face generally parallel to each other, side faces continuous between said first and second faces, and through-holes extending from the first face to the second face through the dielectric block, applying, through formation, an outer conductor film onto said first face, second face and side faces of said dielectric block, and also, applying, through formation, first inner conductor films and second inner conductor films through gaps, in the vicinity of opening portions of said first face, onto inner peripheral surfaces of said respective through-holes.

The method of manufacturing a dielectric resonator device according to a twelfth aspect of the present invention is characterized in that in a method according to the tenth or eleventh aspect, said dielectric block is formed through employment of common molding metal molds, thereby to produce dielectric resonator devices having various resonator device characteristics by differentiating positions of the gaps within the respective through-holes.

The method of manufacturing a dielectric resonator device according to a thirteenth aspect of the present invention is characterized in that in a method according to the tenth or eleventh aspect, said dielectric block is formed through employment of common molding metal molds, thereby to produce dielectric resonator devices having various resonator device characteristics by differentiating widths of the gaps within the respective through-holes.

The method of manufacturing a dielectric resonator device according to a fourteenth aspect of the present invention is characterized in that in a method according to the tenth or eleventh aspect, said dielectric block is formed through employment of common molding metal molds, thereby to produce dielectric resonator devices having various resonator device characteristics by differentiating positions and widths of the gaps within the respective through-holes.

A dielectric resonator device according to a fifteenth aspect of the present invention is characterized in that it includes a dielectric substrate having resonance electrodes on its first main surface and a ground electrode on its second main surface, with the resonance electrodes being conductively connected to said ground electrode in the vicinity of an edge portion at one side of said dielectric substrate, and auxiliary electrodes conductively connected to said ground electrode and extending from the other edge portion of said dielectric substrate which confronts said one edge portion thereof, toward positions near open ends of said resonance electrodes.

A dielectric resonator device according to a sixteenth aspect of the present invention is characterized in that it includes a dielectric substrate having resonance electrodes on its first main surface and a ground electrode on its second main surface, said resonance electrodes being adapted to be open at opposite ends thereof, and auxiliary electrodes conductively connected to said ground electrode and extending from two opposed edge portions of said dielectric substrate toward positions near open ends of said resonance electrodes.

A method of manufacturing a dielectric resonator device according to a seventeenth aspect of the present invention is characterized in that it includes the steps of forming a dielectric substrate having resonance electrodes on its first main surface and a ground electrode on its second main surface, said resonance electrodes being conductively connected to said ground electrode in the vicinity of an edge portion at one side of said dielectric substrate, and also, forming auxiliary electrodes conductively connected to said ground electrode and extending from the other edge portion of said dielectric substrate which confronts said one edge portion thereof, towards position near open ends of said resonance electrodes.

A method of manufacturing a dielectric resonator device according to an eighteenth aspect of the present invention is characterized in that it includes the steps of forming a dielectric substrate having resonance electrodes on its first main surface and a ground electrode on its second main surface, said resonance electrodes being adapted to be open at opposite ends thereof, and also forming auxiliary electrodes conductively connected to said ground electrode and extending from two opposed edge portions of said dielectric substrate toward positions near open ends of said resonance electrodes.

The method of manufacturing a dielectric resonator device according to a nineteenth aspect of the present invention is characterized in that in the method according to the seventeenth or eighteenth aspect, it is arranged to produce dielectric resonator devices having various resonator characteristics by differentiating positions of gaps between said resonance electrodes and said auxiliary electrodes.

The method of manufacturing a dielectric resonator device according to a twentieth aspect of the present invention is characterized in that in the method according to the seventeenth or eighteenth aspect, it is arranged to produce dielectric resonator devices having various resonator characteristics by differentiating widths of gaps between said resonance electrodes and said auxiliary electrodes.

The method of manufacturing a dielectric resonator device according to a twenty-first aspect of the present invention is characterized in that in the method of manufacturing a dielectric resonator device according to the seventeenth or eighteenth aspect, it is arranged to produce dielectric resonator devices having various resonator characteristics by differentiating positions and widths of gaps between said resonance electrodes and said auxiliary electrodes.

A dielectric resonator device according to a twenty-second aspect of the present invention is characterized in that it includes a dielectric substrate having resonance electrodes on its first main surface and a ground electrode on its second main surface, said respective resonance electrodes being conductively connected to said ground electrode in the vicinity of an edge portion of said dielectric substrate, and auxiliary electrodes conducted to said ground electrode and extending from the other edge portion of said dielectric substrate, toward positions near open ends of said respective resonance electrodes respectively.

A dielectric resonator device according to a twenty-third aspect of the present invention is characterized in that it includes a dielectric substrate having resonance electrodes on its first main surface and a ground electrode on its second main surface, said respective resonance electrodes being adapted to be open at opposite ends thereof, and auxiliary electrodes conductively connected to said ground electrode and extending from two-opposed edge portions of said dielectric substrate toward positions near open ends of said respective resonance electrodes respectively.

A method of manufacturing a dielectric resonator device according to a twenty-fourth aspect of the present invention is characterized in that it includes the steps of forming a dielectric substrate having resonance electrodes on its first main surface and a ground electrode on its second main surface, said respective resonance electrodes being conductively connected to said ground electrode in the vicinity of an edge portion of said dielectric substrate, and also, forming auxiliary electrodes conductively connected to said ground electrode and extending from the other edge portion of said dielectric substrate toward positions hear open ends of said resonance electrodes respectively.

A method of manufacturing a dielectric resonator device according to a twenty-fifth aspect of the present invention is characterized in that it includes the steps of forming a dielectric substrate having resonance electrodes on its first main surface and a ground electrode on its second main surface, said resonance electrodes being respectively adapted to be open at opposite ends thereof, and also forming auxiliary electrodes conductively connected to said ground electrode and extending from two opposed edge portions of said dielectric substrate, toward positions near open ends of said resonance electrodes respectively.

The method of manufacturing a dielectric resonator device according to twenty-sixth aspect of the present invention is characterized in that in the method according to the twenty-fourth or twenty-fifth aspect, it is arranged to produce dielectric resonator devices having various resonator device characteristics by differentiating respective positions of gaps between said resonance electrodes and said auxiliary electrodes.

The method of manufacturing a dielectric resonator device according to twenty-seventh aspect of the present invention is characterized in that in the method according to the twenty-fourth or twenty-fifth aspect, it is arranged to produce dielectric resonator devices having various resonator device characteristics by differentiating respective widths of gaps between said resonance electrodes and said auxiliary electrodes.

The method of manufacturing a dielectric resonator device according to twenty-eighth aspect of the present invention is characterized in that in the method according to the twenty-fourth or twenty-fifth aspect, it is arranged to produce dielectric resonator devices having various resonator device characteristics by differentiating respective positions and respective widths of gaps between said resonance electrodes and said auxiliary electrodes.

Functions

General functions of the dielectric resonator device and the method of manufacturing said dielectric resonator device according to the present invention as referred to above will be briefly explained hereinbelow.

In the above dielectric resonator device according to the first aspect, the dielectric block has the first face and the second face generally parallel to each other, the side faces continuous between said first and second faces, and through-holes extending from the first face to the second face through the dielectric block, while the outer electrode is formed over said first face, said second face, and said side faces of said dielectric block, and the first inner electrodes and second inner electrodes are formed, through gaps, at least in the vicinity of opening portions at one side, on the inner peripheral faces of said through-holes. As stated above, at least one side of the first and second inner electrodes formed in the inner peripheral face of the through-holes within the dielectric block acts as the resonance electrodes so as to function as TEM mode dielectric resonators.

In the above dielectric resonator device according to the second aspect, the dielectric block has the first face and the second face generally parallel to each other, the side faces continuous between said first and second faces, and through-holes extending from the first face to the second face through the dielectric block, with the outer electrode is formed over said first face, said second face, and said side faces of said dielectric block, and first inner electrodes and second inner electrodes are formed, through gaps, in the vicinity of opening portions of said first face, on inner peripheral faces of said through-holes. Of the first and second inner electrodes formed on the inner peripheral faces of the through-holes within the dielectric block, the inner electrodes at one side contiguous to the outer electrode on the second surface normally function as the TEM mode dielectric resonators which resonate at ¼ wavelength.

In the above method of manufacturing the dielectric resonator device according to the third aspect, the dielectric block having the first face and the second face generally parallel to each other, the side faces continuous between said first and second faces, and the through-holes extending from the first face to the second face through-the dielectric block is formed, and the outer conductor film is formed on said first face, second face and sides faces of said dielectric block, and further the first inner conductor films and second inner conductor films are formed through gaps, at least in the vicinity of opening portions at one side, ont inner peripheral faces of said through-holes. By the above method, the outer conductor film formed on the first face, the second face and the side faces act as the outer electrode, while the inner conductor films at least at one side of the first and second inner conductor films formed in the inner peripheral surfaces of the dielectric block function as the resonance electrodes.

In the above method of manufacturing the dielectric resonator device according to the fourth aspect, the dielectric block having a first face and second face generally parallel to each other, side faces continuous between said first and second faces, and through-holes extending from the first face to the second face through the dielectric block is prepared, and the outer conductor film is formed on said first face, second face and side faces of said dielectric block, and also the first inner conductor films and second inner conductor films are formed through gaps, in the vicinity of opening portions of said first face, on the inner peripheral faces of said through-holes respectively. By the above method, the outer conductor film formed on the first face, the second face and the side faces act as the outer electrode, while the inner conductor films contiguous from the opening portion of the second face of the first and second inner conductor films formed on the inner peripheral surfaces of the dielectric block function as the resonance electrodes, and thus, the dielectric resonator device having the resonator length of ¼ wavelength is obtained.

In the above method of manufacturing the dielectric resonator device according to the fifth aspect, the dielectric block is formed through employment of common molding metal molds, and the dielectric resonator devices having various resonator characteristics are obtained by differentiating positions of the gaps within the respective through-holes. By the positions of the above gaps, the lengths of the inner conductor films at least at one side acting as the resonance electrodes are varied, whereby in spite of the use of the dielectric block formed by the common molding metal molds, the dielectric resonator device having the predetermined resonator characteristics may be obtained.

In the above method of manufacturing the dielectric resonator device according to the sixth aspect, the dielectric block is formed through employment of common molding metal molds, and the dielectric resonator devices having various resonator characteristics are obtained by differentiating widths of the gaps within the respective through-holes. By the size of the widths for the gaps, the capacity produced between the first and second inner electrodes is varied, whereby in spite of the use of the dielectric block formed by the common metal molds, the dielectric resonator device having the predetermined resonance characteristics may be obtained.

In the above method of manufacturing the dielectric resonator device according to the seventh aspect, the dielectric block is formed through employment of common molding metal molds, and the dielectric resonator devices having various resonator characteristics are obtained by differentiating positions and widths of the gaps within the respective through-holes. By the positions of the above gaps, the lengths of the inner conductor films at least at one side acting as the resonator electrodes are varied, while, by the size of widths for the gaps, the capacity produced between the first and second inner electrodes is varied, whereby in spite of the use of the dielectric block formed by the common metal molds, the dielectric resonator device having the predetermined resonance characteristics may be obtained.

In the above dielectric resonator device according to the eighth aspect, the dielectric block has the first face and the second face generally parallel to each other, side faces continuous between said first and second faces, and the through-holes extending from the first face to the second face through the dielectric block, while the outer electrode is formed over said first face, said second face, and said side faces of said dielectric block, and first inner electrodes and second inner electrodes are respectively formed, through gaps, at least in the vicinity of opening portions at one side, on inner peripheral faces of said respective through-holes. As stated above, at least one side of the first and second inner electrodes formed in the inner peripheral face of the through-holes within the dielectric block acts as the resonance electrodes so as to function on the whole as TEM mode dielectric resonator device of a plurality of stages.

In the above dielectric resonator device according to the ninth aspect, the dielectric block has the first face and the second face generally parallel to each other, side faces continuous between said first and second faces and through-holes extending from the first face to the second face through the dielectric block, while outer electrode is formed over said first face, said second face, and said side faces of said dielectric block, and the first inner electrodes and second inner electrodes are respectively formed, through gaps, in the vicinity of opening portions of said first face, on the inner peripheral faces of said respective through-holes. Of the first and second inner electrodes formed on the inner peripheral faces of the through-holes within the dielectric block, the inner electrodes at one side contiguous to the outer electrode on the second surface normally function as the TEM mode dielectric resonator device of a comb-line type which resonate at ¼ wavelength respectively.

In the above method of manufacturing the dielectric resonator device according to the tenth aspect, the dielectric block having the first face and the second face generally parallel to each other, the side faces continuous between said first and second faces, and through-holes extending from the first face to the second face through the dielectric block is formed, and the outer conductor film is formed on said first face, second face and side faces of said dielectric block, and also, first inner conductor films and second inner conductor films are formed through gaps, at least in the vicinity of opening portions at one side, onto the inner peripheral faces of said respective through-holes. By the above method, the outer conductor film formed on the first face, the second face and the side faces act as the outer electrode, while the inner conductor films at least at one side of the first and second inner conductor films formed on the inner peripheral surfaces of the dielectric block function as the resonance electrodes, and thus, the dielectric resonator device of the plurality of stages may be obtained.

In the above method of manufacturing the dielectric resonator device according to the eleventh aspect, the dielectric block having the first face and the second face generally parallel to each other, side faces continuous between said fist and second faces, and the through-holes extending from the first face to the second face through the dielectric block is formed, and the outer conductor film is formed on said first face, second face and side faces of said dielectric block, and also, the first inner conductor films and second inner conductor films are formed through gaps, in the vicinity of opening portions of said first face, on the inner peripheral faces of said respective through-holes. By the above method, the outer conductor film formed on the first face, the second face and the side face act as the outer electrode, while the inner conductor films contiguous from the opening portion of the second face of the first and second inner conductor films formed on the inner peripheral surfaces of the dielectric block function as the resonance electrodes, and thus, the dielectric resonator device of a plurality of stages having the resonator length of ¼ wavelength is obtained.

In the above method of manufacturing the dielectric resonator device according to the twelfth aspect, the dielectric block is formed through employment of common molding metal molds, and the dielectric resonator devices having various resonator device characteristics are obtained by differentiating positions of the gaps within the respective through-holes. By the positions of the above gaps, the lengths of the inner conductor films at least at one side acting as the resonance electrodes are varied, whereby in spite of the use of the dielectric block formed by the common molding metal molds, the dielectric resonator device having the predetermined resonance characteristics may be obtained.

In the above method of manufacturing the dielectric resonator device according to the thirteenth aspect, the dielectric block is formed through employment of common molding metal molds, and the dielectric resonator devices having various resonator characteristics are obtained by differentiating widths of the gaps within the respective through-holes. By the size of the widths for the gaps, the capacity produced between the first and second inner electrodes is varied, whereby in spite of the use of the dielectric block formed by the common metal molds, the dielectric resonator device having the predetermined resonator device characteristics may be obtained.

In the above method of manufacturing the dielectric resonator device according to the fourteenth aspect, the dielectric block is formed through employment of common molding metal molds, and the dielectric resonator devices having various resonator device characteristics by differentiating positions and widths of the gaps within the respective through-holes. By the positions of the above gaps, the lengths of the inner conductor films at least at one side acting as the resonance electrodes are varied, while, by the size of the width for the gaps, the capacity produced between the first and second inner electrodes is varied, whereby in spite of the use of the dielectric block formed by the common metal molds, the dielectric resonator device having the predetermined resonance characteristics may be obtained.

In the above dielectric resonator device according to the fifteenth aspect, the dielectric substrate has resonance electrodes on its first main surface and a ground electrode on its second main surface, with the resonance electrodes being conducted to said ground electrode in the vicinity of an edge portion at one side of said dielectric substrate, and the auxiliary electrodes are conducted to said ground electrode and extending from the other edge portion of said dielectric substrate which confronts said one edge portion thereof, towards position near open ends of said resonance electrodes. By the above arrangement, the resonator device may be used as a strip-line resonator.

In the above dielectric resonator device according to the sixteenth aspect, the dielectric substrate has the resonance electrodes on its first main surface and the ground electrode on its second main surface, with the resonance electrodes being adapted to be open at opposite ends thereof, and the auxiliary electrodes are conducted to said ground electrodes and extending from opposed two edge portions of said dielectric substrate towards position near open ends of said resonance electrodes. By the above structure, the resonator device can be used as a strip-line resonator.

In the above method of manufacturing the dielectric resonator device according to the seventeenth aspect, the dielectric substrate having the resonance electrodes on its first main surface and a ground electrode on its second main surface is formed, with the resonance electrodes being conducted to said ground electrode in the vicinity of an edge portion at one side of said dielectric substrate, and also, auxiliary electrodes are conducted to said ground electrode and extending form the other edge portion of said dielectric substrate which confronts said one edge portion thereof, towards position near open ends of said resonance electrodes, whereby the dielectric resonator device is produced.

In the above method of manufacturing the dielectric resonator device according to the eighteenth aspect, the dielectric substrate having the resonance electrodes on its first main surface and the ground electrode on its second main surface is formed, with the resonance electrodes being adapted to be open at opposite ends thereof, and also, auxiliary electrodes are conducted to said ground electrode and extending from opposed two edge portions of said dielectric substrate, towards position near open ends of said resonance electrodes, and thus, the dielectric resonator device is produced.

In the above method of manufacturing the dielectric resonator device according to the nineteenth aspect, it is arranged to produce dielectric resonator devices having various resonator characteristics by differentiating positions of gaps between said resonance electrodes and said auxiliary electrodes. By the positions of the above gaps, the lengths of the resonance electrodes are varied, whereby in spite of the use of the common dielectric substrates, the dielectric resonator device having the predetermined resonance characteristics may be obtained.

In the above method of manufacturing the dielectric resonator device according to the twentieth aspect, it is arranged to produce dielectric resonator devices having various resonator characteristics by differentiating widths of gaps between said resonance electrodes and said auxiliary electrodes. By the widths for the gaps, the capacity produced between the resonance electrode and auxiliary electrodes is varied, whereby in spite of the use of the common dielectric substrate, the dielectric resonator device having the predetermined resonance characteristics may be obtained.

In the above method of manufacturing the dielectric resonator device according to the twenty-first aspect, it is arranged to produce dielectric resonator devices having various resonator characteristics by differentiating positions and widths of gaps between said resonance electrodes and said auxiliary electrodes. By the positions of the above gaps, the lengths of the resonance electrodes are varied, while, by the size of the widths, the capacity produced between the resonance and auxiliary electrodes is varied, whereby in spite of the use of common dielectric substrate, the dielectric resonator device having the predetermined resonance characteristics may be obtained.

In the dielectric resonator device according to the twenty-second aspect, the dielectric substrate has the resonance electrodes on its first main surface and a ground electrode on its second main surface, respective resonance electrodes being conducted to said ground electrode in the vicinity of an edge portion of said dielectric substrate, and the auxiliary electrodes are conducted to said ground electrode and extending from the other edge portion of said dielectric substrate towards position near open ends of said respective resonance electrodes respectively. By the above construction, the dielectric device may be used as a strip-line filter.

In the dielectric device according to the twenty-third aspect, the dielectric substrate has the resonance electrodes on its first main surface and a ground electrode on its second main surface, with the respective resonance electrodes being adapted to be open at opposite ends thereof, and the auxiliary electrodes are conducted to said ground electrodes are conducted to said ground electrode and extending from opposed two edge portions of said dielectric substrate towards position near open ends of said respective resonance electrodes respectively. The above construction makes it possible to use the resonator device for a strip-line filter.

In the method of manufacturing the dielectric resonator device according to the twenty-fourth aspect, the dielectric substrate having the resonance electrodes on its first main surface and the ground electrode on its second main surface is formed, with the respective resonance electrodes being conducted to said ground electrode in the vicinity of an edge portion of said dielectric substrate, and also, the auxiliary electrodes are conducted to said ground electrode and extending from the other edge portion of said dielectric substrate towards portion near open ends of said resonance electrodes respectively.

In the method of manufacturing the dielectric resonator device according to the twenty-fifth aspect, the dielectric substrate having resonance electrodes on its first main surface and a ground electrode on its second main surface is formed, with the resonance electrodes being respectively adapted to be open at opposite ends thereof, and the auxiliary electrodes are conducted to said ground electrode and extending from opposed two edge portions of said dielectric substrate towards position near open ends of said resonance electrodes respectively.

In the method of manufacturing the dielectric resonator device according to the twenty-sixth aspect, it is arranged to produce dielectric resonator devices having various resonator device characteristics by differentiating respective positions of gaps between said resonance electrodes and said auxiliary electrodes. By the positions of the above gaps, the lengths of the resonance electrodes are varied, whereby in spite of the use of the common dielectric substrate, the dielectric resonator device having the predetermined resonance characteristics may be obtained.

In the method of manufacturing the dielectric resonator device according to the twenty-seventh aspect, it is arranged to produce dielectric resonator devices having various resonator device characteristics by differentiating respective widths of gaps between said resonance electrodes and said auxiliary electrodes. By the widths for the gaps, the capacity produced between the resonance electrode and auxiliary electrodes is varied, whereby in spite of the use of the common dielectric substrate the dielectric resonator device having the predetermined resonance characteristics may be obtained.

In the method of manufacturing the dielectric resonator device according to the twenty-eighth aspect, it is arranged to produce dielectric resonator devices having various resonator device characteristics by differentiating respective positions and respective widths of gaps between said resonance electrodes and said auxiliary, electrodes. By the positions of the above gaps, the lengths of the resonance electrodes are varied, while by the size of the widths, the capacity produced between the resonance and auxiliary electrodes is varied, whereby in spite of the use of the common dielectric substrate, the dielectric resonator device having the predetermined resonance characteristics may be obtained.

BRIEF DESCRIPTION OF THE DRAWINGS

These and other objects and features of the present invention will become apparent from the following description of preferred embodiments thereof with reference to the accompanying drawings, in which.

DETAILED DESCRIPTION OF THE INVENTION

Figure 1A:
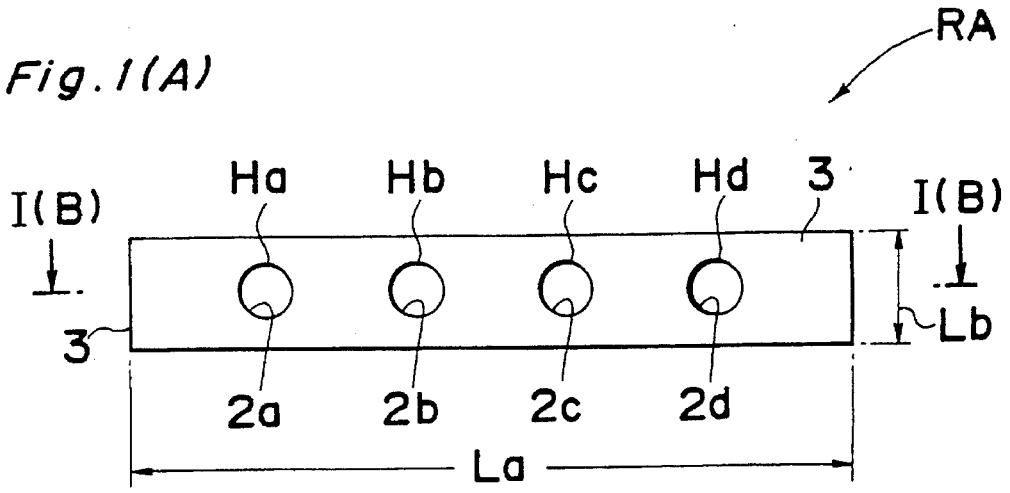
FIG. 1(A) is a front elevational view of a dielectric resonator device according to one preferred embodiment of the present invention.

Before the description of the present invention proceeds, it is to be noted that like parts are designated by like reference numerals throughout the accompanying drawings.

FIRST EMBODIMENT

Figure 1B:
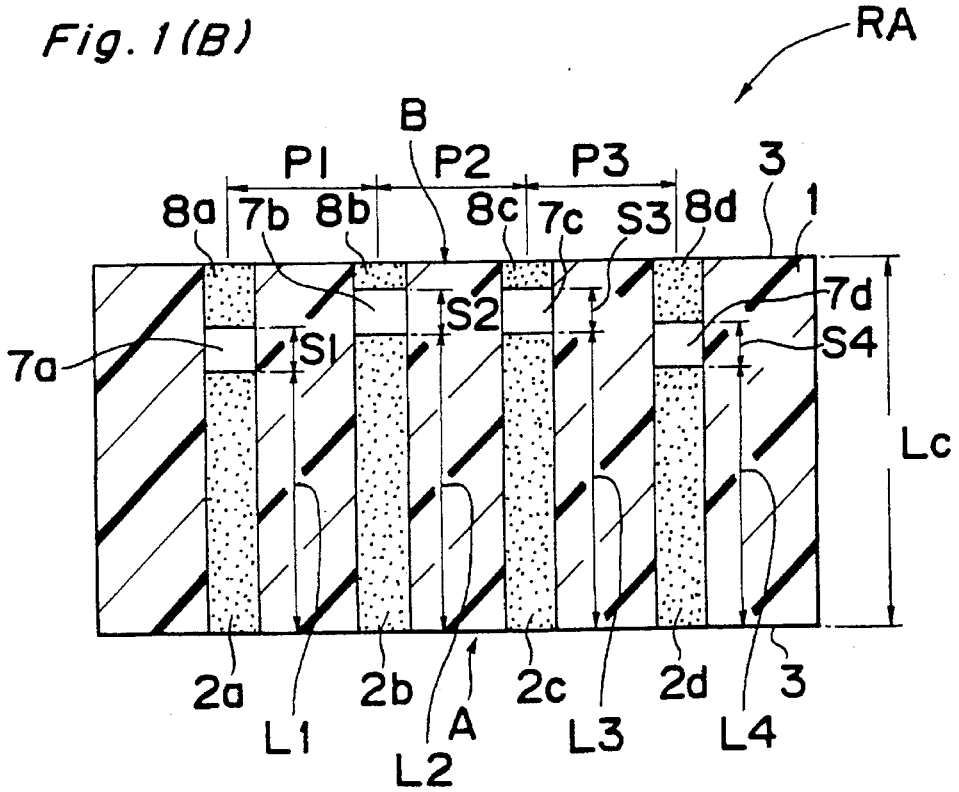
FIG. 1(B) is a cross section taken along the line I(B)—I(B) in FIG. 1(A)
Figure 2:
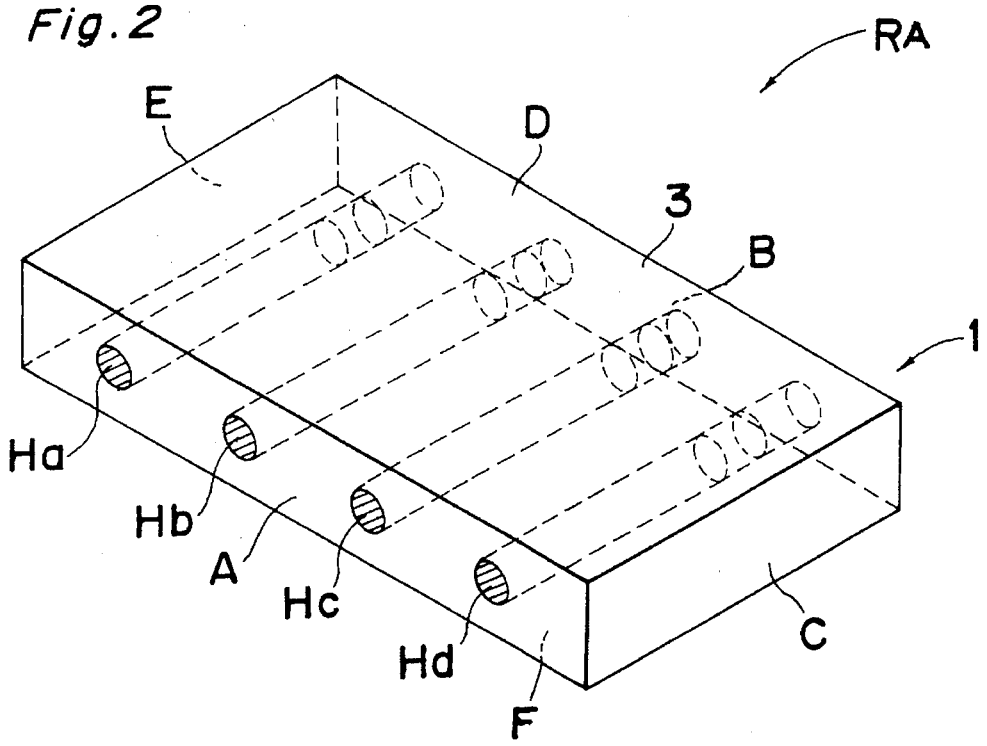
FIG. 2 is a perspective view of the dielectric resonator device of FIG. 1(A)

Referring now to the drawings, there is shown in FIGS. 1(A), 1(B) and 2, a dielectric resonator device RA according to one preferred embodiment of the present invention, which generally includes a dielectric block 1 in the form of a hexahedron or in a rectangular cubic box-like configuration having a first face A and a second face B which are generally parallel to each other and side faces C, D, E and F contiguously provided between said first and second faces, four through-holes Ha, Hb, Hc and Hd formed to extend through the dielectric block 1 from the first face A to the second face B, first inner electrodes 2*a*, 2*b*, 2*c* and 2*d* and second inner electrodes 8*a*, 8*b*, 8*c* and 8*d* respectively formed on the inner peripheral surfaces of the respective through-holes Ha to Hd, and an outer electrode 3 formed on the first face A, the second face B, and the side faces C, D, E and F.

The dielectric block 1 is formed through employment of a, molding metal mold which serves as a standard (not particularly shown). Although the dielectric block to be obtained by the one metal mold has the same shape and same dimensions on the whole, including positions of the through-holes Ha to Hd, resonator devices having different resonator characteristics may be obtained by changing the lengths of the first inner electrodes 2*a* to 2*d* and the second inner electrodes 8*a* to 8*d* to be formed on the respective inner peripheral faces of said through-holes Ha to Hd. By way of example, it becomes possible to constitute a plurality of kinds of band-pass filters having different center frequencies and band widths, etc. by use of the dielectric block produced by the that same common molding metal mold.

Figure 6:
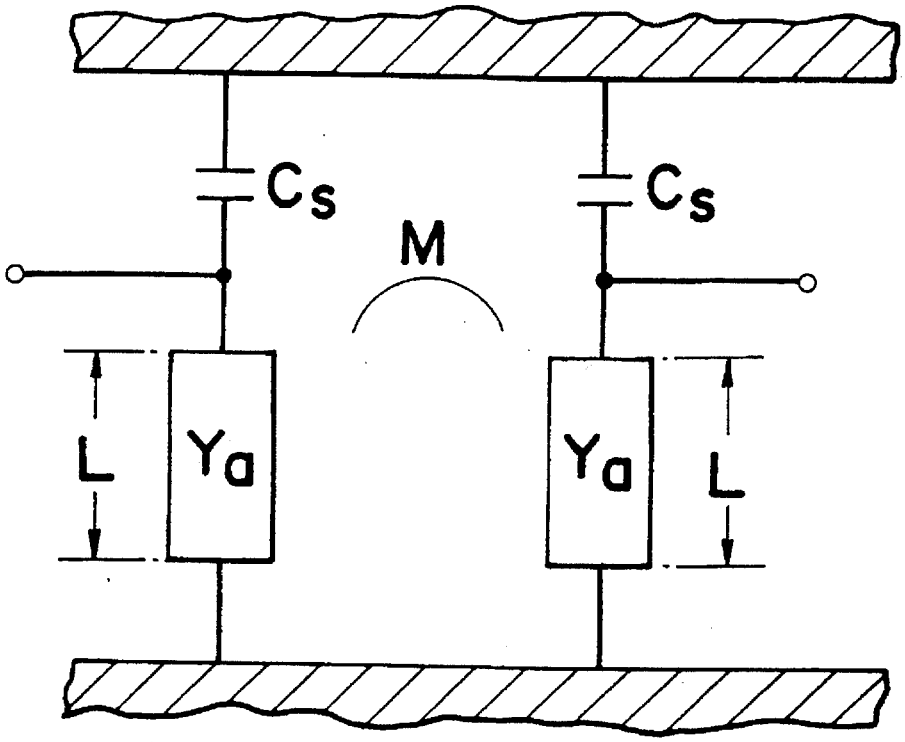
FIG. 6 is an equivalent circuit diagram of a 2 stage comb-line type filter.

Referring now to FIG. 6, showing an equivalent circuit diagram of a general 2 stage comb-line type filter, the factors determining the center frequencies and band widths of the filter will be explained.

In the first place, the center frequency fo is represented by an equation as follows from the resonance condition.

$$2\pi fcCs = Ya \cdot \cot \theta o$$

$$\theta o = \frac{\sqrt{\epsilon r}}{c} \cdot 2\pi foL$$

where $\epsilon r$ is a dielectric constant of a resonator surrounding substance, Cs is a straight capacity, L is a resonator length, Ya is admittance of the resonator, and C is a light velocity. Meanwhile, a coupling coefficient k is represented by a following equation, and is determined by each admittance and θ.

$$k = \frac{(Yo - Ye)/Ya}{1 + \frac{\Theta o}{\sin\Theta o \cdot \cos\theta o}}$$

where Yo is an admittance in the odd mode, and Ye is an admittance in the even mode.

Specific examples will now be described with reference to FIGS. 1(A) and 1(B).

In FIGS. 1(A) and 1(B), there is shown a dielectric resonator device RA according to one preferred embodiment of the present invention, which comprises a dielectric block 1 having a first face A and a second face B generally parallel to each other, side faces C,D,E,F which are continuous between the first and second faces A and B, and through-holes Ha, Hb, Hc and Hd extending from the first face A to the second face B through the dielectric block 1, an outer electrode 3 formed over the first face A, the second face B, and the side faces of said dielectric block 1, and first inner electrodes 2*a*, 2*b*, 2*c* and 2*d* and second inner electrodes 8*a*, 8*b*, 8*c*, and 8*d* formed, with gaps 7*a*, 7*b*, 7*c* and 7*d* there between at least in the vicinity of openings at one end, on inner peripheral faces of said through-holes Ha to Hd.

More specifically, the first inner electrodes 2*a*, 2*b*, 2*c*, and 2*d*, and the second inner electrodes 8*a*, 8*b*, 8*c*, and 8*d* are each formed on the inner peripheral faces of the respective through-holes Ha, Hb, Hc and Hd with the gaps, i.e. non-electrode regions 7*a*, 7*b*, 7*c* and 7*d*, provided therebetween, and one end of each of the inner electrodes 2*a* to 2*d* and 8*a* to 8*d* is conductively connected to the outer electrode 3.

The first inner electrodes 2*a* to 2*d* act as resonance electrodes, with the first face A of the dielectric block 1 functioning as a short-circuiting face. Lengths of the first inner electrodes 2*a*, 2*b*, 2*c* and 2*d* are represented by L1, L2, L3 and L4, and widths of the gaps 7*a*, 7*b*, 7*c* and 7*d* are denoted by S1, S2, S3 and S4 respectively. Meanwhile, the lengths of the respective sides of the dielectric block are represented by La, Lb and Lc, and the intervals between the respective inner electrodes are represented by P1 between 2*a* and 2*b*, P2 between 2*b* and 2*c*, and P3 between 2*c* and 2*d*. Here, the relationship of the respective intervals may be set as P1=P2=P3 or P1≠P2≠P3≠P1.

Although the resonance frequency of each resonator is determined by various factors, in the embodiment as shown in FIGS. 1(A) and 1(B), the resonance frequency of the first resonator formed by the first inner electrode 2*a* is determined by L1 and S1, the resonance frequency of the second resonator formed by the first inner electrode 2*b* is determined by L2 and S2, the resonance frequency of the third resonator formed by the first inner electrode 2*c* is determined by L3 and S3, and further, the resonance frequency of the fourth resonator formed by the first inner electrode 2*d* is determined by L4 and S4. Meanwhile, the coupling amounts between the neighboring resonators are determined by P1, P2 and P3, and S1, S2, S3 and S4, and in this case, the intervals P1, P2 and P3 between the inner electrodes are set by the metal mold dimensions and are fixed.

The dielectric resonator device RA as shown in FIGS. 1(A) and 1(B) functions as a band-pass filter "F1" having a center frequency of f1, and a band width of BW1, but in order to produce filters on a large scale, band-pass filters with different characteristics must be produced. By changing the dimensions of the first and second inner electrodes within the respective through-holes while employing dielectric blocks prepared with the same metal mold, such band-pass filters may be manufactured after designing in the manner as described hereinbelow.

Firstly, in the case where a band-pass filter "F2" with the band width equal to BW1, and the center frequency of f2 higher than f1 (f2>f1) is to be produced on a large scale, the length of the first inner electrode 2*a* is set to be L12 shorter than L1, that of the first inner electrode 2*b* is set to be L22 shorter than L2, that of the first inner electrode 2*c* is set to be L32 shorter than L3, and that of the first inner electrode 2*d* is set to be L42 shorter than L4. The widths S1, S2, S3 and S4 of the gaps 7*a* to 7*d* between the first inner electrodes 2*a* to 2*d*, and the second inner electrodes 8*a* to 8*d*, are set to be the same as in the case where the center frequency is f1 in principle, and accordingly, the lengths of the second inner electrodes 8*a* to 8*d* are set to be longer than those in the case of the band-pass filter "F1". As described above, when the center frequency is higher, each length of the second inner electrodes 8*a* to 8*d* becomes generally longer. However, in the case where the center frequency f2 of this filter "F2" is spaced away from the center frequency f1 of the filter "F1" too far to neglect the variation in the pass-band width, the widths S1, S2, S3 and S4 of the gaps are slightly increased, with corresponding slight increase of the lengths L12, L22, L32, and L42 of the first inner electrodes in design for manufacturing.

Then, for mass-production of the filter having the pass-band width narrower than BW1, with the center frequency set at f2, the widths S1, S2, S3 and S4 are each increased at the designing stage.

In the above case, if the influence over the resonance frequency of each resonator can not be neglected due to the alteration of the values for S1, S2, S3 and S4, the values for the lengths L12, L22, L32 and L42 of the respective first inner electrodes are altered in the directions towards L12→L1, L22→L2, L32→L3, and L42→L4 respectively, and simultaneously, the lengths of the second inner electrodes 8*a*, 8*b*, 8*c* and 8*d* are reduced by the amounts in which the lengths of the first inner electrodes L12, L22, L32 and L42 are increased respectively in the designing.

Conversely, for mass-production of the filter having the pass-band width wider than BW1, with the center frequency set at f2, the widths S1, S2, S3 and S4 are each reduced at the designing stage.

In the above case, if the influence over the resonance frequency of each resonator can not be neglected due to the alteration of the values for S1, S2, S3 and S4, the values for the lengths L12, L22, L32 and L42 of the respective first inner electrodes are further reduced and simultaneously, the lengths of the second inner electrodes 8*a*, 8*b*, 8*c* and 8*d* are increased.

As described above, various kinds of filters as desired are manufactured on a large scale by determining the lengths of the first and second inner electrodes and the widths of the gaps at the stage of designing. It is to be noted here that the lengths of the respective electrodes and the widths of the gaps as referred to above may be set at the predetermined values by grinding the inner electrodes at the gap portions through employment of a grained stone.

In the case where a band-pass filter "F3" with the band width equal to BW1, and the center frequency of f3 lower than f1 (f3<f1) is to be produced on a large scale, the length of the first inner electrode 2*a* is set to be L13 longer than L1, that of the first inner electrode 2*b* is set to be L23 longer than L2, and that of the first inner electrode 2*c* is set to be L33 longer than L3, and that of the first inner electrode 2*d* is set to be L43 longer than L4. The widths S1, S2, S3 and S4 of the gaps 7*a* to 7*d* between the first inner electrodes 2*a* to 2*d*, and the second inner electrodes 8*a* to 8*d*, are set to be the same as in the case where the center frequency is f1 in principle, and accordingly the lengths of the second inner electrodes 8*a* to 8*d* are set to be shorter than those in the case of the band-pass filter "F1". As described above, when the center frequency is lower, each length of the second inner electrodes 8*a* to 8*d* becomes generally shorter. However, in the case where the center frequency f3 of this filter "F3" is spaced away from the center frequency f1 of the filter "F1" too far to neglect the variation in the pass-band width, the widths S1, S2, S3 and S4 of the gaps are slightly decreased, with corresponding slight decrease of the lengths L13, L23, L33, and L43 of the first inner electrodes in design for manufacturing.

Then, for mass-production of the filter having the pass band width narrower than BW1, with the center frequency set at f3, the widths S1, S2, S3 and S4 are each increased at the designing stage.

In the above case, if the influence over the resonance frequency of each resonator can not be neglected due to the alteration of the values for S1, S2, S3 and S4, the values for the lengths L13, L23, L33 and L43 of the respective first inner electrodes are further increased, and simultaneously, the lengths of the second inner electrodes 8*a*, 8*b*, 8*c* and 8*d* are reduced in the designing.

Conversely, for mass-production of the filter having the pass band width wider than BW1, with the center frequency set at f3, the widths S1, S2, S3 and S4 are each decreased at the designing stage. In the above case, if the influence over the resonance frequency of each resonator can not be neglected due to the alteration of the values for S1, S2, S3 and S4, the values for the lengths L13, L23, L33 and L43 of the respective first inner electrodes are altered in the directions towards L13→L1, L23→L2, L33→L3, and L43→L4 respectively, and simultaneously, the lengths of the second inner electrodes 8*a*, 8*b*, 8*c* and 8*d* are increased by the amounts in which the lengths of the first inner electrodes L12, L22, L32 and L42 are decreased respectively in the designing.

As described above, various kinds of filter as desired are manufactured on a large scale by determining the lengths of the first and second inner electrodes and the widths of the gaps at the stage of designing.

In the manner described so far, it may be so arranged to obtain the dimensional data for each part which will provide the desired characteristics at the stage of designing or trial production, and to carry out mass production on the basis of such data. However, even in the case where dielectric resonator devices differ in their resonance frequencies, etc. to so large an extent that they can not be constituted by a single common dielectric block, it may be, for example, so arranged to classify the resonance frequencies, etc. into ranks and then to use a common dielectric block for each rank.

Figure 4A:
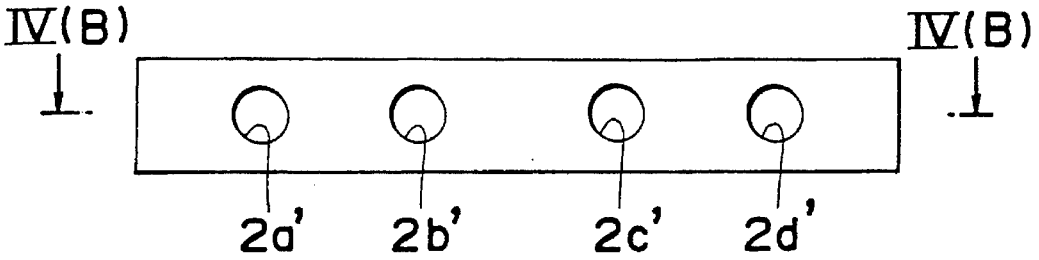
Fig.4(A) PRIOR ART
FIG. 4(A) is a front elevational view of a conventional dielectric resonator device (already referred to)
Figure 4B:
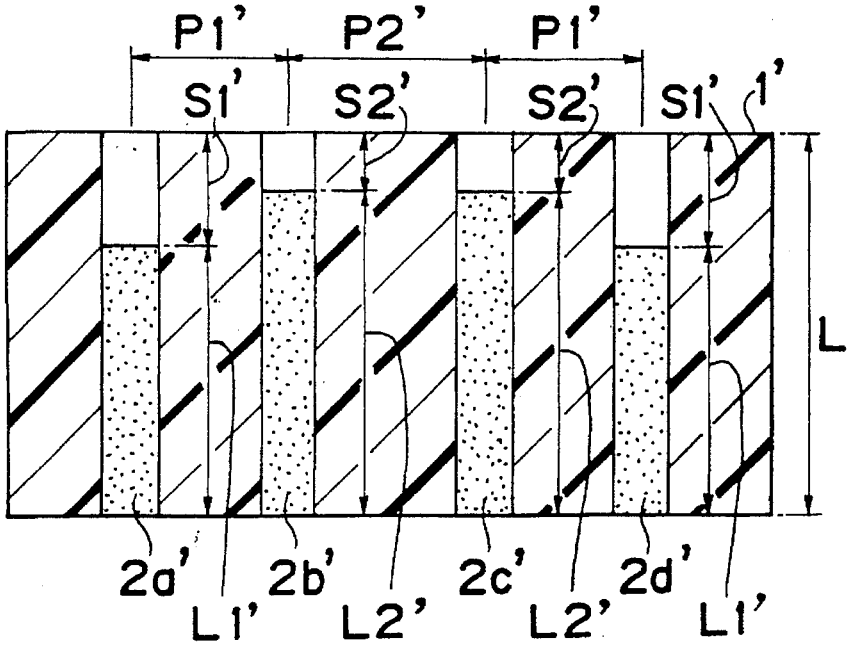
Fig.4(B) PRIOR ART
FIG. 4(B) is a cross section taken along the line IV(B)—IV(B) in FIG. 4(A) (already referred to)
Figure 5:
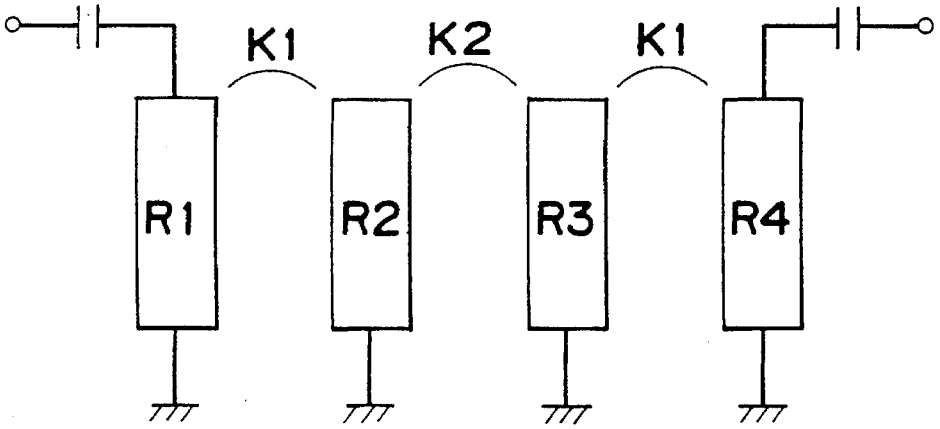
FIG. 5 is an equivalent circuit diagram of a conventional symmetrical 4 stage band-pass filter.

Thus, it becomes possible to produce various bandpass filters having center frequencies and pass-band widths as desired with dielectric blocks formed through employment of common metal molds. This is made possible by the presence of the second inner electrodes 8*a*, 8*b*, 8*c* and 8*d* which are contiguous with the outer electrode 3 formed on the second surface B of the dielectric block shown in FIGS. 1(A) and 1(B), and this is the effect peculiar to the present invention which is not available with the conventional dielectric resonator device as shown in FIGS. 4(A) and 4(B). It is to be noted here that in the embodiment as shown in FIGS. 1(A) and 1(B), although input and output terminals for the signals are omitted in the drawings, known constructions disclosed, for example, in Japanese Patent Laid-Open Publications Tokkaisho Nos. 59-51606, 60-114004, or Japanese Utility Model Laid-Open Publications Jikkaisho No. 58-54102 or 63-181002 may be adopted.

It should be noted here that although in the dielectric resonator device RA according to the foregoing embodiment, the dielectric block in the hexahedron shape is employed, the concept of the present invention is not limited in its application to the dielectric block of such shape.

Moreover, the dielectric block to be employed is not limited to those molded by one-piece molding, but may be one as disclosed, for example in Japanese Patent Publication Tokkohei No. 3-15841, in which two dielectric substrates are employed, and by joining these two dielectric substrates, through-holes are formed in the joined faces. In the first embodiment of FIGS. 1(A) and 1(B), although the present invention has been described as applied to the dielectric resonator device of the ¼ wavelength type, it may be so modified and applied to a dielectric resonator device in which the respective resonance electrodes resonate to ½ wavelength by providing spaces in at both open ends of the respective through-holes. Additionally, in the first embodiment, although the inner diameter of each through-hole is set to be constant in its axial direction, the shape of the through-hole may be modified, for example, into a tapered shape or stepped shape.

SECOND EMBODIMENT

Figure 3A:
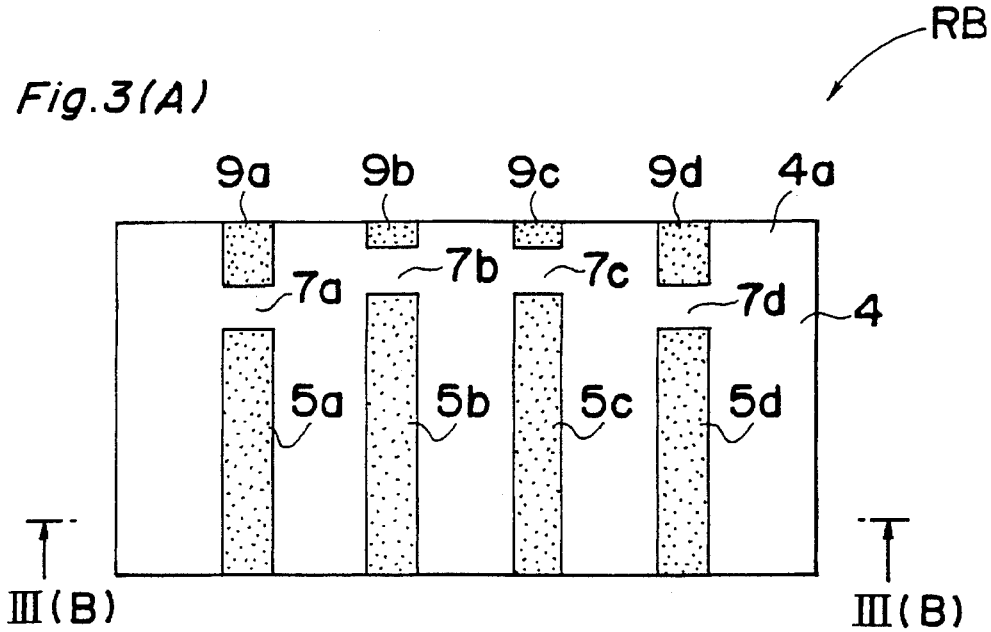
FIG. 3(A) is a top plan view of a dielectric resonator device according to a second embodiment of the present invention.
Figure 3B:
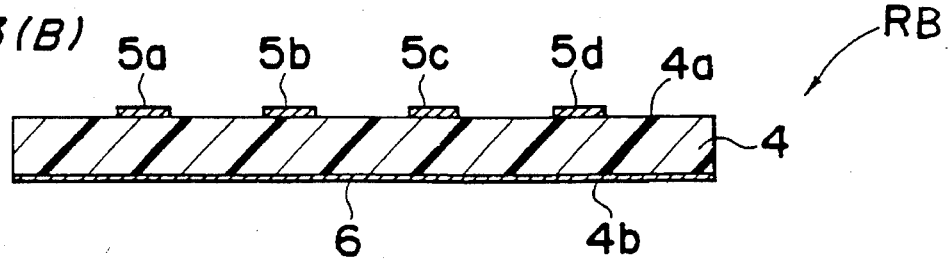
FIG. 3(B) is a cross section taken along the line III(B)—III(B) in FIG. 3(A)

Referring further to FIGS. 3(A) and 3(B), there is shown a dielectric resonator device RB according to a second embodiment of the present invention, which includes a dielectric substrate 4 having resonance electrodes 5*a*, 5*b*, 5*c* and 5*d* on its first main surface 4*a* and a ground electrode 6 on its second main surface 4*b*, with the resonance electrodes 5*a* to 5*d* being conductively connected to the ground electrode 6 in the vicinity of an edge portion at one side of said dielectric substrate 4, and auxiliary electrodes 9*a*, 9*b*, 9*c* and 9*d* conductively connected to the ground electrode 6 and extending from the other edge portion of said dielectric substrate which confronts said one edge portion thereof, toward positions near open ends of said resonance electrodes 5*a* to 5*d*.

More specifically, the electrodes 5*a*, 5*b*, 5*c* and 5*d* and 9*a*, 9*b*, 9*c* and 9*d* are formed on the first main surface 4*a* and non-electrode regions 7*a*, 7*b*, 7*c* and 7*d* are provided therebetween as shown. In these electrodes, the electrodes 5*a*, 5*b*, 5*c* and 5*d* function as strip lines forming the resonant electrodes, while the electrodes 9*a*, 9*b*, 9*c* and 9*d* act as the auxiliary electrodes. Moreover, the ground electrode 6 is extended from the second main face 4*b* (i.e. the reverse face) of the dielectric substrate 4 towards the edge portion adjacent the short-circuited ends of the resonance electrodes 5*a*, 5*b*, 5*c* and *d*, and toward the edge portion adjacent the ends side of the auxiliary electrodes 9*a*, 9*b*, 9*c* an 9*d*. By the above structure, the resonator device RB functions as the strip-line type dielectric resonator device, and can be used as the four stage band-pass filter. In this case also, the filter characteristics can be set by the length of the strip-line from the short-circuited end, and the length of the non-electrode portions 7*a*, 7*b*, 7*c* and 7*d*.

It is to be noted here that in the first and second embodiments as described so far, although the present invention has been described with reference to the comb-line type filter as one example, the concept of the present invention is not limited in its application to the above, but may be applied to a filter of an inter-digital type as well.

As is clear from the foregoing description, according to the present invention, various kinds of dielectric resonator devices having different characteristics may be readily obtained without increasing the kinds or variations of the dielectric blocks or dielectric substrates, with a marked reduction in the manufacturing cost.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as includes therein.

What is claimed is:

1. A dielectric resonator device which comprises a dielectric block having a first face and a second face generally parallel to each other, side faces continuous between said first and second faces, and at least one through-hole extending from the first face to the second face through the dielectric block, opening portions of said at least one through-hole located at said first and second face, respectively, an outer electrode formed over said first face, said second face, and said side faces of said dielectric block, and a first inner electrode and second inner electrode formed in said at least one through-hole and being unequal in length, a gap between said first and second inner electrodes, said gap being at least in the vicinity of one of said opening portions and disposed on an inner peripheral surface of said at least one through-hole, a surface of said gap being flush with the inner peripheral surface, one of said first inner electrode and said second inner electrode functioning as a resonator with an open end thereof at said gap and a short-circuit end thereof conductively connected to said outer electrode.

2. A dielectric resonator device which comprises a dielectric block having a first face and a second face generally parallel to each other, side faces continuous between said first and second faces, and at least one through-hole extending from the first face to the second face through the dielectric block, openings of said at least one through-hole located at said first and second face, respectively, an outer electrode formed over said first face, said second face, and said side faces of said dielectric block, and a first inner electrode and second inner electrode formed in said at least one through-hole and being unequal in length, a gap between said first and second inner electrodes, said gap being at least in the vicinity of the opening of said at least one through-hole at said first face and disposed on an inner peripheral surface of said at least one through-hole, a surface of said gap being flush with the inner peripheral surface, one of said first inner electrode and said second inner electrode functioning as a resonator with an open end thereof at said gap and a short-circuit end thereof conductively connected to said outer electrode.

3. A dielectric resonator device as claimed in claim 1 or 2, wherein said gap is spaced completely away from a midpoint of said at least one through-hole.

4. A dielectric resonator device which comprises a dielectric block having a first face and a second face generally parallel to each other, side faces continuous between said first and second faces, and at least one through-hole extending from the first face to the second face through the dielectric block, opening portions of said at least one through-hole located at said first and second face, respectively, an outer electrode formed over said first face, said second face, and said side faces of said dielectric block, and a first inner electrode and second inner electrode formed in said at least one through-hole, a gap between said first and second inner electrodes, said gap being at least in the vicinity of one of said opening portions and disposed on an inner peripheral surface of said at least one through-hole, a surface of said gap being flush with the inner peripheral surface, one of said first inner electrode and said second inner electrode functioning as a quarter-wavelength resonator with an open end thereof at said gap and a short-circuit end thereof conductively connected to said outer electrode.

5. A dielectric resonator device which comprises a dielectric block having a first face and a second face generally parallel to each other, side faces continuous between said first and second faces, and at least one through-hole extending from the first face to the second face through the dielectric block, openings of said at least one through-hole located at said first and second face, respectively, an outer electrode formed over said first face, said second face, and said side faces of said dielectric block, and a first inner electrode and second inner electrode formed in said at least one through-hole, a gap between said first and second inner electrodes, said gap being at least in the vicinity of the opening of said at least one through-hole at said first face and disposed on an inner peripheral surface of said at least one through-hole, a surface of said gap being flush with the inner peripheral surface, one of said first inner electrode and said second inner electrode functioning as a quarter-wavelength resonator with an open end thereof at said gap and a short-circuit end thereof conductively connected to said outer electrode.

6. A dielectric resonator device as claimed in claim 4 or 5, wherein said first and second inner electrodes are unequal in length.

7. A dielectric resonator device which comprises a dielectric block having a first face and a second face generally parallel to each other, side faces continuous between said first and second faces and a plurality of through-holes extending from the first face to the second face through the dielectric block, respective opening portions of said plurality of through-holes located at said first and second face, respectively, an outer electrode formed over said first face, said second face, and said side faces of said dielectric block, and first inner electrode means and second inner electrode means respectively formed in said plurality of through-holes, a gap between said first and second inner electrode means, said gaps each in the vicinity of one of said opening portions at said first face and disposed on inner peripheral surfaces of said respective through-holes, a surface of said gap being flush with the corresponding inner peripheral surface, one of said first inner electrode means and said second inner electrode means functioning as a quarter-wavelength resonator with an open end thereof at said gap and a short-circuit end thereof conductively connected to said outer electrode.

8. A dielectric resonator device which comprises a dielectric block having a first face and a second face generally parallel to each other, side faces continuous between said first and second faces and a plurality of through-holes extending from the first face to the second face through the dielectric block, respective opening portions of said plurality of through-holes located at said first and second face, respectively, an outer electrode formed over said first face, said second face, and said side faces of said dielectric block, and first inner electrode means and second inner electrode means respectively formed in said plurality of through-holes, a gap between said first and second inner electrode means, said gaps each being at least in the vicinity of one of said opening portions and disposed on inner peripheral surfaces of said respective through-holes, a surface of said gap being flush with the corresponding inner peripheral surface, one of said first inner electrode means and said second inner electrode means functioning as a quarter-wavelength resonator with an open end thereof at said gap and a short-circuit end thereof conductively connected to said outer electrode.

9. A dielectric resonator device as claimed in claim 8 or 7, wherein said first and second inner electrode means are unequal in length.

10. A dielectric resonator device as claimed in claim 4, 5, 8 or 7 wherein said dielectric block comprises a dielectric ceramic material.

11. A method of manufacturing a dielectric resonator device which comprises the steps of:

forming a dielectric block having a first face and a second face generally parallel to each other, side faces continuous between said first and second faces, and at least one through-hole extending from the first face to the second face through the dielectric block, applying an outer conductor film onto said first face, second face and side faces of said dielectric block, and applying a first inner conductor film and a second inner conductor film in said at least one through-hole with a gap between said first and second inner conductor films, said gap being at least in the vicinity of one of said first and second faces and disposed on an inner peripheral surface of said at least one through-hole, a surface of said gap being flush with the inner peripheral surface, one of said first inner electrode film and said second inner electrode film functioning as a quarter-wavelength resonator with an open end thereof at said gap and a short-circuit end thereof conductively connected to said outer electrode.

12. A method of manufacturing a dielectric resonator device as claimed in claim 11, wherein said first and second inner conductor films are applied substantially simultaneously into said inner peripheral surface.

13. A method of manufacturing a dielectric resonator device which comprises the steps of:

forming a dielectric block having a first face and a second face generally parallel to each other, side faces continuous between said first and second faces, and at least one through-hole extending from the first face to the second face through the dielectric block, openings of said at least one through-hole located at said first and second face, respectively, applying an outer conductor film onto said first face, second face and side faces of said dielectric block, and applying a first inner conductor film and a second inner conductor film in said at least one through-hole with a gap between said first and second inner conductor films, said gap being in the vicinity of the opening at said first face and disposed on an inner peripheral surface of said at least one through-hole, a surface of said gap being flush with the inner peripheral surface, one of said first inner electrode film and said second inner electrode film functioning as a quarter-wavelength resonator with an open end thereof at said gap and a short-circuit end thereof conductively connected to said outer electrode.

14. A method of manufacturing a plurality of dielectric resonator devices having common predetermined resonator characteristics comprising the steps of:

preparing at least one common metal mold;

employing said at least one common metal mold in said step of forming a dielectric block by using the steps as claimed in either claim 11 or 13 to thereby form a plurality of said dielectric blocks; and controlling respective lengths of said first and second inner conductor films while maintaining a constant width of the gap within each said through-hole of each of said plurality of dielectric blocks, to produce the plurality of dielectric resonator devices having predetermined resonator characteristics.

15. A method of manufacturing a plurality of dielectric resonator devices having common predetermined resonator characteristics comprising the steps of:

preparing at least one common metal mold;

employing said at least one common metal mold in said step of forming a dielectric block by using the steps as claimed in either claim 11 or 13, to thereby form a plurality of said dielectric blocks; and controlling respective length of the first and second inner conductor films within each said through-hole of each of said plurality of dielectric blocks, to produce the plurality of dielectric resonator devices having predetermined resonator characteristics.

16. A method of manufacturing a plurality of dielectric resonator devices having common predetermined resonator characteristics comprising the steps of:

preparing at least one common metal mold;

employing said at least one common metal mold in said step of forming a dielectric block by using the steps as claimed in either claim 11 or 13 to thereby form a plurality of said dielectric blocks; and controlling the respective length of only one of said first and second inner conductor films so as to control the width of the gap within each said through-hole of each of said plurality of dielectric blocks, to produce the plurality of dielectric resonator devices having predetermined resonator characteristics.

17. A method of manufacturing a dielectric resonator device which comprises the steps of:

forming a dielectric block having a first face and a second face generally parallel to each other, side faces continuous between said first and second face, and a plurality of through-holes extending from the first face to the second face through the dielectric block, respective opening portions of said plurality of through-holes located at said first and second face, respectively, applying an outer conductor film onto said first face, second face and side faces of said dielectric block, and applying first inner conductor films and second inner conductor films in said plurality of through-holes respectively with a gap between said first and second inner conductor films, said gaps each being at least in the vicinity of one of said opening portions and disposed on inner peripheral surfaces of said respective through-holes, a surface of said gap being flush with the corresponding inner peripheral surface, one of said first inner electrode film and said second inner electrode film functioning as a quarter-wavelength resonator with an open end thereof at said gap and a short-circuit end thereof conductively connected to said outer electrode.

18. A method of manufacturing a dielectric resonator device which comprises the steps of:

forming a dielectric block having a first face and a second face generally parallel to each other, side faces continuous between said first and second faces and a plurality of through-holes extending from the first face to the second face through the dielectric block, respective opening portions of said plurality of through-holes located at said first and second face, respectively, applying an outer conductor film onto said first face, second face and side faces of said dielectric block, and applying first inner conductor films and second inner conductor films in said plurality of through-holes respectively with a gap between said first and second inner conductor films, said gaps each being in the vicinity of the opening portions at said first face, and disposed on inner peripheral surfaces of said respective through-holes, a surface of said gap being flush with the corresponding inner peripheral surface, one of said first inner electrode film and said second inner electrode film functioning as a quarter-wavelength resonator with an open end thereof at said gap and a short-circuit end thereof conductively connected to said outer electrode.

19. A method of manufacturing a plurality of dielectric resonator devices having common predetermined resonator characteristics comprising the steps of:

preparing at least one common metal mold;

employing said at least one common metal mold in said step of forming a dielectric block by using the step as claimed in either claim 17 or 18, to thereby form a plurality of said dielectric blocks; and controlling respective lengths of said first and second inner conductor films while maintaining constant respective widths of the gaps within each respective through-hole, to produce the plurality of dielectric resonator devices having predetermined resonator characteristics.

20. A method of manufacturing a plurality of dielectric resonator devices having common predetermined resonator characteristics comprising the steps of;

preparing at least one common metal mold;

employing said at least one common metal mold in said step of forming a dielectric block by using the steps as claimed in either claim 17 or 18, to thereby form a plurality of said dielectric blocks; and controlling respective lengths of only one of said first and second inner conductor films so as to control respective widths of the gaps within each respective through-hole, to produce the plurality of dielectric resonator devices having predetermined resonator characteristics.

21. A method of manufacturing a plurality of dielectric resonator devices having common predetermined resonator characteristics comprising the steps of;

preparing at least one common metal mold;

employing said at least one common metal mold in said step of forming a dielectric block by using the steps as claimed in either claim 17 or 18, to thereby form a plurality of said dielectric blocks; and controlling respective lengths of the first and second inner conductor films within each respective through-hole, to produce the plurality of dielectric resonator device having predetermined resonator characteristics.

22. A method of manufacturing a dielectric resonator device as claimed in claim 11, 13, 17 or 18, wherein said dielectric block comprises a dielectric ceramic material.

23. A method as claimed in claim 11, 13, 17 or 18, wherein said first and second inner conductive films are unequal in length.

24. A method of manufacturing a dielectric resonator device which comprises the steps of:

forming a dielectric block having a first face and a second face generally parallel to each other, side faces continuous between said first and second faces, and at least one through-hole extending from the first face to the second face through the dielectric block, applying an outer conductor film onto said first face, second face and side faces of said dielectric block, and applying a first inner conductor film and a second inner conductor film in said at least one through-hole which are unequal in length and with a gap between said first and second inner conductor films, said gap being at least in the vicinity of one of said first and second faces and disposed on an inner peripheral surface of said at least one through-hole, a surface of said gap being flush with the inner peripheral surface, one of said first inner electrode film and said second inner electrode film functioning as a resonator with an open end thereof at said gap and a short-circuit end thereof conductively connected to said outer electrode.

25. A method of manufacturing a dielectric resonator device which comprises the steps of:

forming a dielectric block having a first face and a second face generally parallel to each other, side faces continuous between said first and second faces, and at least one through-hole extending from the first face to the second face through the dielectric block, openings of said at least one through-hole located at said first and second face, respectively, applying an outer conductor film onto said first face, second face and side faces of said dielectric block, and applying a first inner conductor film and a second inner conductor film in said at least one through-hole which are unequal in length and with a gap between said first and second inner conductor films, said gap being in the vicinity of the opening at least first face and disposed on an inner peripheral surface of said at least one through-hole, a surface of said gap being flush with the inner peripheral surface, one of said first inner electrode film and said second inner electrode film functioning as a resonator with an open end thereof at said gap and a short-circuit end thereof conductively connected to said outer electrode.

26. A method as claimed in claim 24 or 25, wherein said gap is spaced completely away from a midpoint of said at least one through-hole.

* * * * *